US005327878A

United States Patent [19]

Wittbrot

[11] Patent Number: 5,327,878

[45] Date of Patent: Jul. 12, 1994

[54] DEVICE FOR HOLDING SPHERICAL PROJECTILES

[75] Inventor: Henry W. P. Wittbrot, Milwaukee, Wis.

[73] Assignee: Benjamin Sheridan Corp., Racine, Wis.

[21] Appl. No.: 939,415

[22] Filed: Sep. 3, 1992

Related U.S. Application Data

[63] Continuation of Ser. No. 702,924, May 20, 1991, abandoned.

[51] Int. Cl.[5] ..... F41B 11/02

[52] U.S. Cl. ..... 124/41.1; 124/51.1; 124/56; 124/82; 221/310

[58] Field of Search ..... 124/41.1, 45, 49, 51.1, 124/56, 63-67, 69, 73, 74, 82; 221/267, 303, 310, 312 R

[56] References Cited

U.S. PATENT DOCUMENTS

| | | | |
|---|---|---|---|
| 2,704,627 | 3/1955 | Brulin et al. | 221/310 X |
| 2,725,868 | 12/1955 | Foster | 124/64 X |
| 2,762,356 | 9/1956 | Foster | 124/51.1 X |
| 2,762,357 | 9/1956 | Foster | 124/51.1 X |
| 3,412,897 | 11/1968 | Slater | 221/310 X |
| 4,046,284 | 9/1977 | Samuelsson | 221/303 X |
| 4,091,791 | 5/1978 | Castelli et al. | 124/73 |
| 4,094,294 | 6/1978 | Speer | 124/56 |
| 4,424,972 | 1/1984 | Vinette | 124/56 X |

*Primary Examiner*—Randolph A. Reese
*Assistant Examiner*—John Ricci

[57] ABSTRACT

A device for holding spherical projectiles in position is described. The two-pronged or fingered device is made up of resilient, elastic, tough and durable material such as elastomers of the class of rubber and which are dimensionally recuperative after being deformed. The two fingered device holds spherical projectiles in place and is sufficiently deformable to allow the projectile to be discharged from the area in which it is held by the retention system.

2 Claims, 2 Drawing Sheets

DEVICE FOR HOLDING SPHERICAL PROJECTILES

This application is a continuation of application Ser. No. 702,924, filed May 20, 1991, now abandoned.

DESCRIPTION OF PRIOR ART

This invention is generally related to devices that discharge spherical projectiles and, more particularly, to air or gas guns that successively discharge paintballs and splatterballs.

A variety of devices, including guns which project paintballs or splatterballs, utilize spherical projectiles which are made up of metal or plastics or plastic-like material. In many of these devices the projectiles are successively discharged. One of the problems with many of these devices is that in successive discharge function, more than one projectile exits from the magazine or storage compartment into the tubular discharge chamber and more than projectile is discharged at once. Another problem is that the projectiles may roll out of the discharge chamber before they are projected by the discharging member. Other systems which use radially enlargeable O-rings or metal retainers are unsatisfactory for certain spherical projections, such as hollow projectiles filled with paint as used in paintball or splatball guns because the projectiles may be torn or broken as they pass into or out of the retention systems.

SUMMARY OF THE INVENTION

The object of the invention is to offer a device to retain spherical projectiles in the discharge chamber in a system that uses spherical projectiles until the discharge member discharges the projectile. For example, in air guns that discharge gelatine encapsulated paintballs in successive-shooting function the spherical projectile may move out of position causing multiple loading of the discharging chamber.

Another object of the invention is to offer a device which prevents multiple loading of spherical projectile into the discharge chamber by holding.

Another object of this invention is to offer a device for retaining hollow spherical projectiles which is not prone to tearing of the projectiles as they pass into or out of the retention system in the operation of the projectile discharging system.

The prongs of the device come in contact with the spherical projectile and hold it in place in the chamber and as the charging member is urged forward the retaining prongs are deformed without damaging or tearing the spherical projectile. The resilient nature of the prongs allows them to return to their original resting position.

These and other important objects will be apparent from the following description.

BRIEF DESCRIPTION OF DRAWINGS

Corresponding reference characters indicate corresponding parts throughout the several views of the drawing.

DETAILED DESCRIPTION OF PREFERRED EMBODIMENTS

Figure 1:
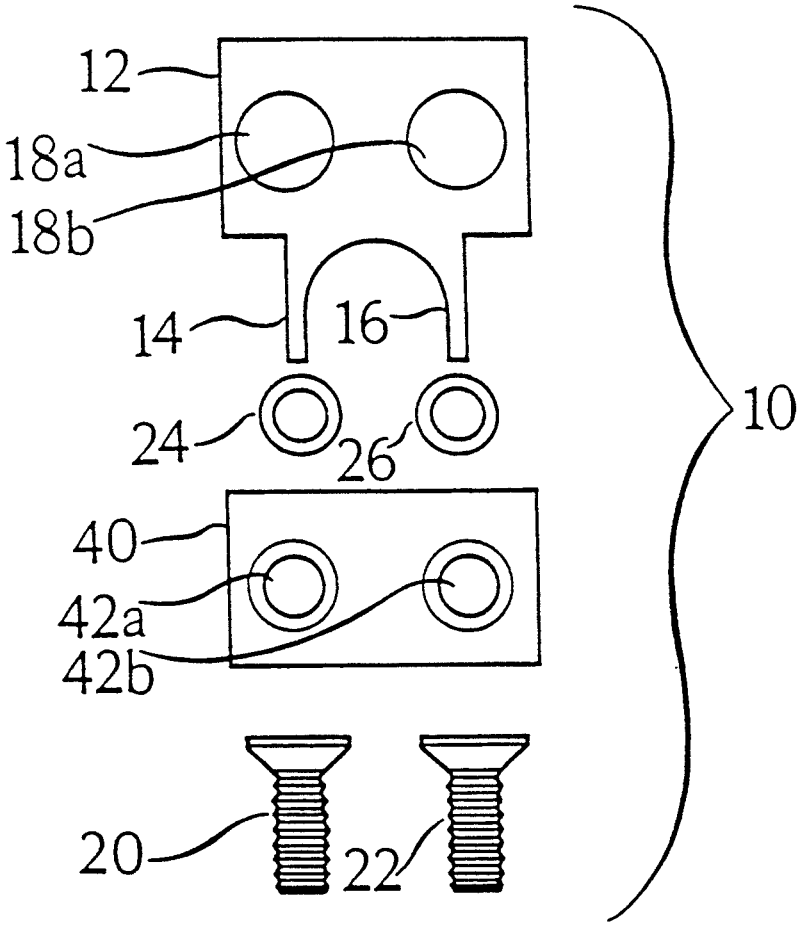
FIG. 1 is an exploded fragmentary view of the spherical projectile retention device.

Referring to FIG. 1, the spherical projectile retention device 10 is shown in a fragmented device in its preferred embodiment consists of a rectangular main portion 12 which has two prongs, 14, 16 in which the distance between the inner opposing surfaces of the two prongs is less than that of the diameter of the spherical projectile which it is to hold in position. The device 10 may be made up of resilient elastic oil and acid proof, tough and durable materials such as elastomers of the class rubber. In the air gun in the example, the retaining unit is screwedly attached to the air gun by two screws, 20, 22, two washers, 24, 26 and a metal plate 40 through screw holes 18 and 42.

Figure 2A:
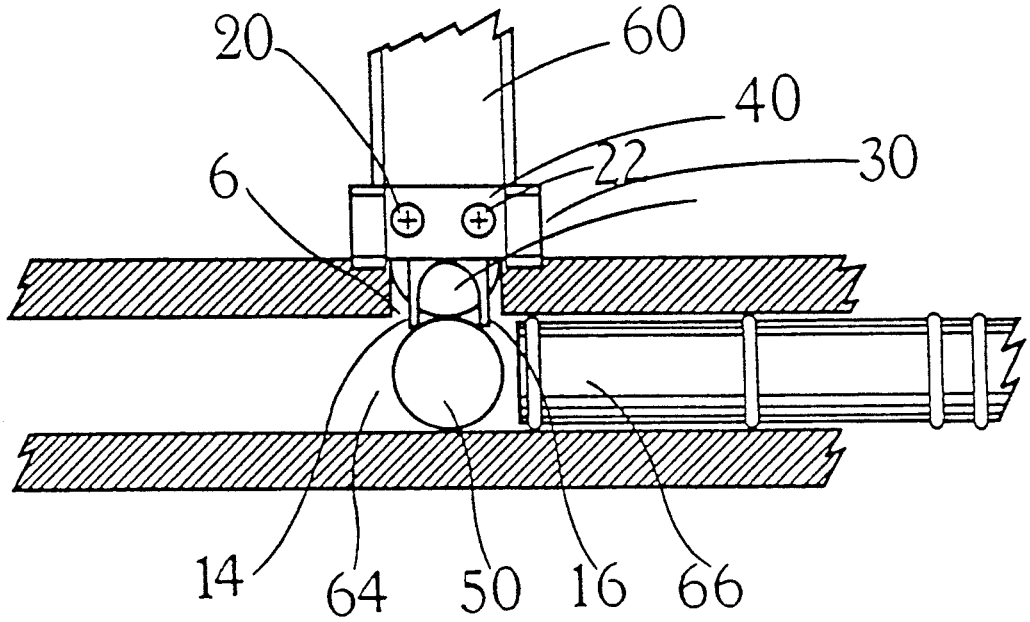
FIG. 2*a* and 2*b* are sequential series of sectional views of the present invention which illustrate the sequential operation of the invention with the discharging member in the predischarge (2*a*) and post discharge (2*b*) positions.
Figure 2B:
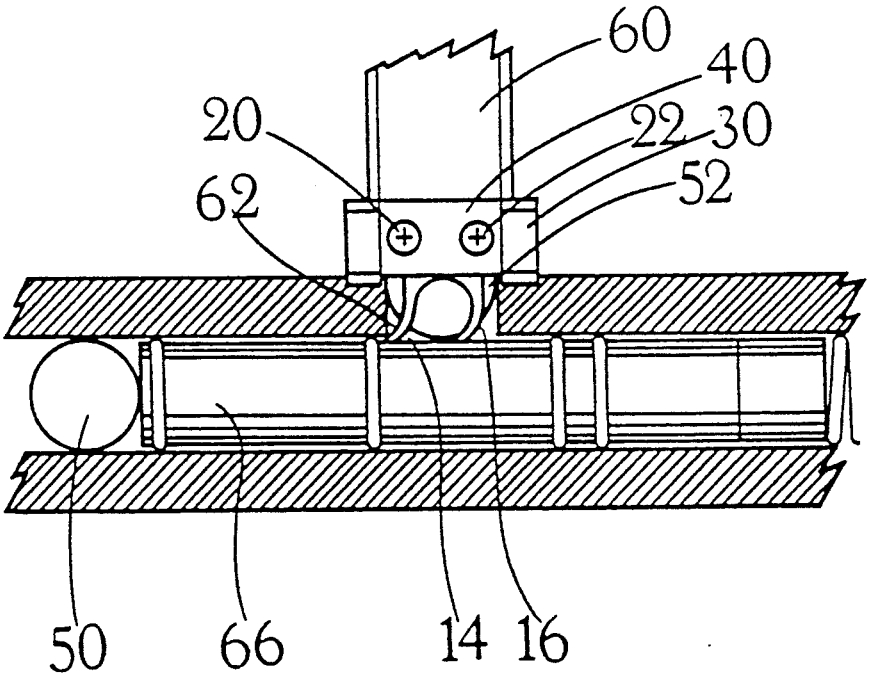

Referring to FIG. 2*a*, the device is shown holding a spherical projectile 50 in place and preventing a second projectile 52 from exiting from the storage chamber 60 through entrance 62 into the charging chamber 64. The spherical projectile is held in place by the prongs of the retention device coming in contact with the projectile. The spherical projectile in its resting position in the discharging chamber lies between the prongs of the retention device. The device by holding a single projectile in the discharge chamber prevents multiple loading. When the projectile is moved out of the resting position the prongs are bent in a forward position. Their elastic nature allows them to return to resting conformation during reloading of the discharge chamber. FIG. 2*b* shows the spherical projectile 50 having been moved out of position and the retention device fingers 14, 16 being deformed by the charging member 66 which has moved the spherical projectile 50 into the charging chamber 64. In this position the charging member 66 prevents the second projectile 52 from entering the discharge chamber 64.

The exemplication set herein illustrate a preferred embodiment of the invention in one form thereof and such exemplifications are not to be construed as limiting the scope of the disclosure or the scope of the invention in any manner.

What is claimed is:

1. Apparatus for releasably securing a spherical projectile in a gaming device, said apparatus comprising: means for defining a round, elongate charging chamber and a storage chamber which provides the projectile through an inlet in the charging chamber; and a holding member secured to said device proximate the inlet, said holding member including first and second resilient prong portions which are elongate and have a width substantially smaller than the radius of the spherical projectile, said prong portions being disposed in substantially parallel relation with one another and having substantially the same shape, said prong portions extending into the charging chamber, transversely to the charging chamber, from one side of the charging chamber to hold the projectile and prevent another projectile from entering the charging chamber.

2. The apparatus of claim 1 wherein the distance between the first and the second prong is less than the diameter of the projectile.

* * * * *